US007356156B2

(12) United States Patent
Rüegg

(10) Patent No.: US 7,356,156 B2
(45) Date of Patent: Apr. 8, 2008

(54) WIRELESS HEADSET WITH ROTATABLE SPEAKER HOUSING

(76) Inventor: Heinz Rüegg, Bürgliweg 13, 8805 Richterswil (CH)

( * ) Notice: Subject to any disclaimer, the term of this patent is extended or adjusted under 35 U.S.C. 154(b) by 209 days.

(21) Appl. No.: 11/002,292

(22) Filed: Dec. 3, 2004

(65) Prior Publication Data

US 2005/0163337 A1 Jul. 28, 2005

Related U.S. Application Data

(63) Continuation of application No. PCT/CH03/00350, filed on Jun. 2, 2003.

(30) Foreign Application Priority Data

Jun. 4, 2002 (CH) ..... 0934/02

(51) Int. Cl.
*H04R 25/00* (2006.01)

(52) U.S. Cl. ..... 381/379; 381/374

(58) Field of Classification Search ..... 381/56, 381/74, 370, 371, 374, 378, 379, 380, 383; 379/430; 455/186, 575.2, 551, 600; 2/208, 2/209; 181/129, 130, 131
See application file for complete search history.

(56) References Cited

U.S. PATENT DOCUMENTS

| | | | | |
|---|---|---|---|---|
| 5,438,626 A | | 8/1995 | Neuman et al. | |
| 5,469,505 A | * | 11/1995 | Gattey et al. | 379/430 |
| 5,506,911 A | * | 4/1996 | Neuman et al. | 381/381 |
| 6,118,882 A | * | 9/2000 | Haynes | 381/374 |
| 6,735,306 B1 | * | 5/2004 | Heinz | 379/430 |
| 6,741,719 B1 | * | 5/2004 | Orten | 381/380 |
| 2001/0002928 A1 | * | 6/2001 | Cummins | 379/430 |

FOREIGN PATENT DOCUMENTS

| | | |
|---|---|---|
| DE | 3325031 C2 | 1/1985 |
| DE | 196 45 307 A 1 | 5/1998 |
| FR | 2 280 283 | 7/1975 |
| GB | 2 304 488 A | 3/1997 |
| WO | WO 95/35011 | 12/1995 |
| WO | WO 00/08894 | 2/2000 |

OTHER PUBLICATIONS

International Search Report; PCT/CH 03/00350; Jul. 14, 2003.

* cited by examiner

*Primary Examiner*—Brian Ensey
(74) *Attorney, Agent, or Firm*—Antonelli, Terry, Stout & Kraus, LLP.

(57) ABSTRACT

In a headset (100, 200) for receiving infrared or radio signals and transforming them into an audio transmission in the audible range, the headset essentially comprises a base housing (101), one continuous or two individually guided supporting bands (102, 103) each with a miniature loudspeaker (300, 400) arranged at the end. The miniature loudspeaker has a loudspeaker body (305, 405) on the ear side, which loudspeaker body assumes a place in the auditory passage or surrounds the whole external ear. The loudspeaker body (305, 405) on the ear side is supported rotatably with respect to the supporting band (102, 103) or a joining part (301, 401).

11 Claims, 4 Drawing Sheets

300,400
102
103
100
101
305
300

405
400

200

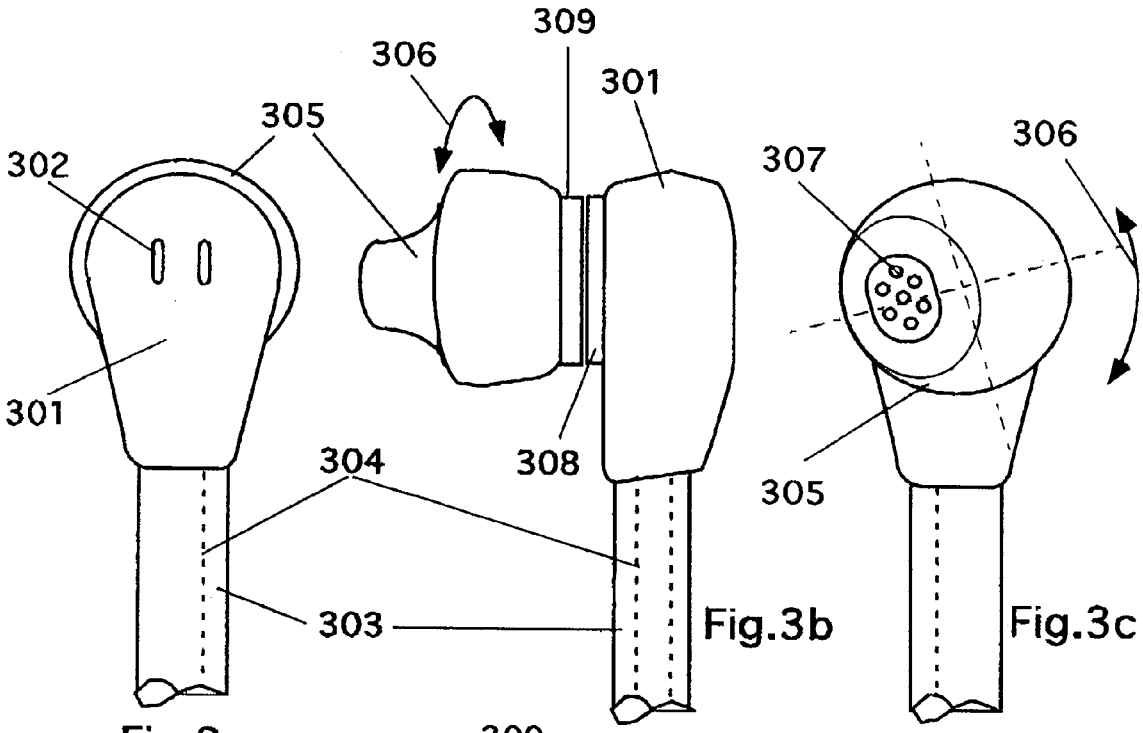
Fig.3a
Fig.3b
Fig.3c
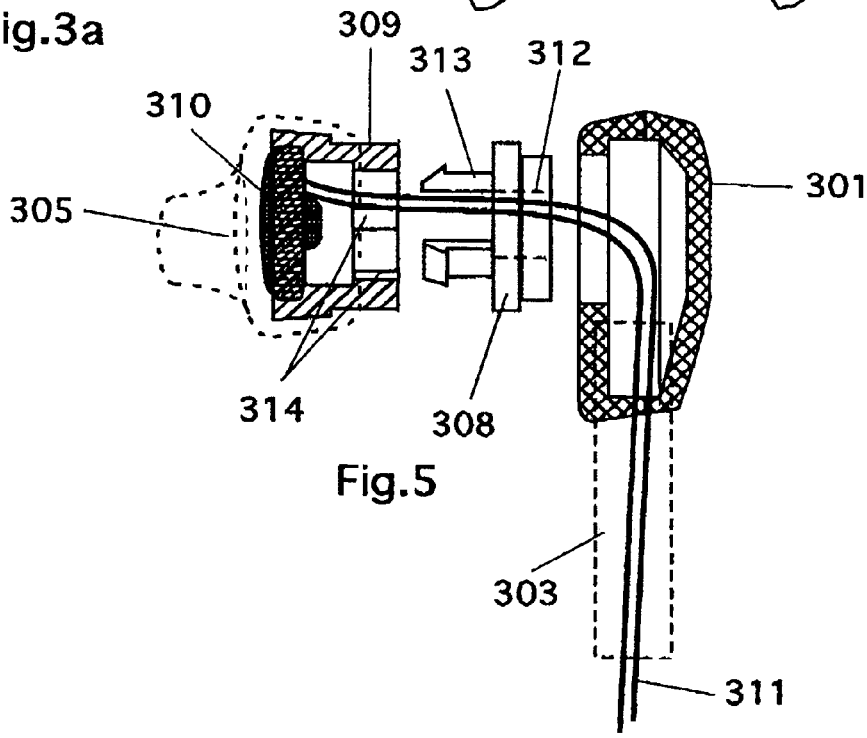
Fig.5

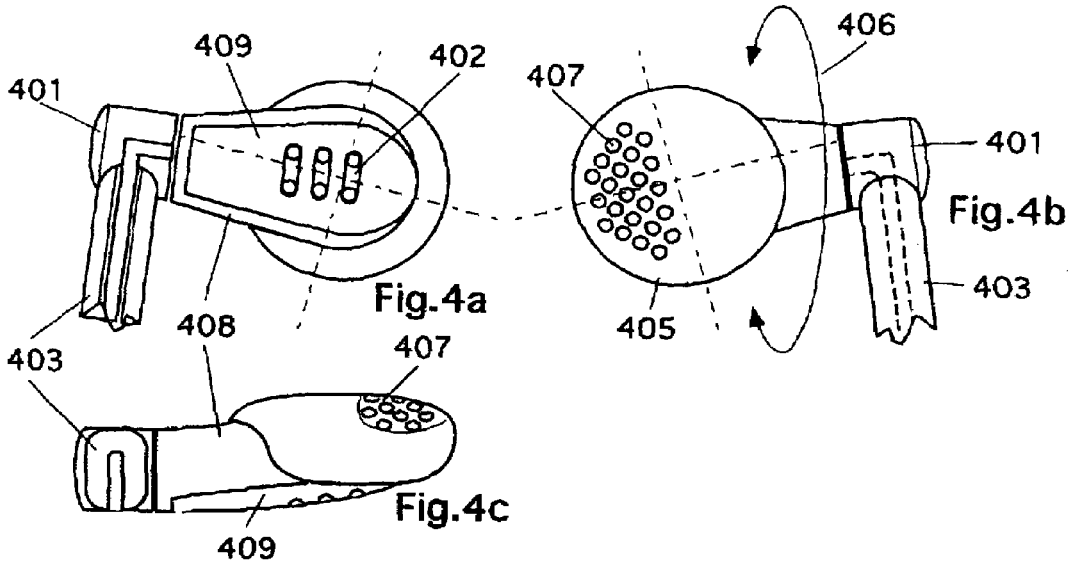
401
409
402
408
403
Fig.4a
406
407
401
405
403
Fig.4b
407
403
409
Fig.4c
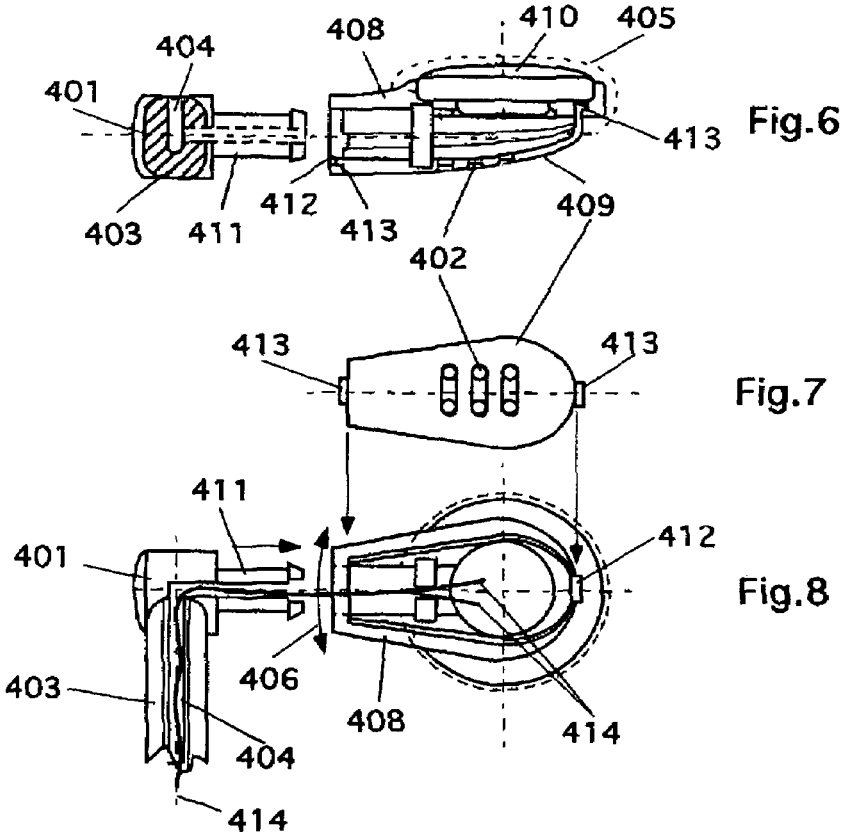
404
408
410
405
401
413
Fig.6
403
411
412
413
409
402
413
413
Fig.7
411
401
412
Fig.8
403
406
408
414
404
414

WIRELESS HEADSET WITH ROTATABLE SPEAKER HOUSING

RELATED APPLICATION

This application is a continuation application of PCT Application No. PCT/CH03/000350 which designated the U.S., filed Jun. 2, 2003, and claims priority under 35 U.S.C. §119 of Switzerland Application No. 934/02 filed in Switzerland on Jun. 4, 2002.

BACKGROUND OF THE INVENTION

The present invention relates to a headset for receiving infrared or radio signals and transforming them into an audio transmission in the audible range, which headset essentially comprises a base housing, one continuous or two individually guided supporting bands each with a miniature loudspeaker arranged at the end, the miniature loudspeaker having a loudspeaker body on the ear side, which loudspeaker body assumes a place in the auditory passage or surrounds the whole external ear.

PRIOR ART

DE-33 25 031 C2 disclosed an infrared headset that comprises two playback transducers connected to each other via a chin band, an electric circuit receiving infrared signals and transforming them into audio signals, and two microphones with microphone amplifiers connected subsequently thereto. The circuitry of this infrared headset is made such that the signals derived from respectively the infrared circuitry or the microphone amplifiers, individually or in combination, are supplied to the playback transducers as selected. The microphones are here arranged spaced apart from each other on the chin band in such fashion that they are located symmetrically with respect to the medial plane of the head of a user, the signals derived from the microphones being supplied out of phase in equal ratio to the other microphone amplifier in each case.

Usually, this infrared headset is effectively connected to a transmitter, which transforms the emitted audio signals, for example from a television set or a hi-fi system, into invisible infrared rays and radiates these into space, where they are received by the infrared headset, a wireless infrared audio transmission thus being capable of implementation. At the same time, such a transmitter is desirably a charging station for the infrared receiver and for at least one battery pack, which in the charged condition is used to operate the infrared headset.

The publication WO 95/35011 A discloses an infrared headset fashioned as a chin-band receiver. This infrared headset essentially comprises a base housing, and two supporting bands each with a miniature loudspeaker arranged at the end. The two supporting bands are supported in the base housing, each of said supporting bands being spreadable in combination with a spring element acting in the region of the support, a comfortable fit of the miniature loudspeakers on the ear being capable of implementation via these spring elements. This headset is turned on and off with a manually actuated switch.

The publications GB 2 304 488 A and FR 2 280 283 A likewise disclose cable-free headsets in which the spreadable band ends, conceived as a headband, likewise permit a flexible fit on the ear and into which there is integrated an on/off switch whose on/off actuation is dependent on the spreading of the band so that manual actuation of the switch is obviated.

All the headsets belonging to the prior art have one thing in common: that the miniature loudspeakers, also called loudspeakers, and their housings are rigidly connected to the supporting bands of the chin-band system. The user of such systems thus wears the headset principally in each case in a slightly forwardly bent or backwardly leaning attitude in such fashion that these systems, independently of whether the user is standing, sitting or walking, hang vertically downwardly by their own weight. In this way, the position of the miniature loudspeakers in the external ears relative to the auditory canal varies upon any change, no matter how minimal, in the position of the head, which leads to the following shortcomings:

a) Every time there is a variation, no matter how small, the miniature loudspeakers adapt to the new position, which leads to friction in the external ears and in the auditory passage, which the user in turn senses as extremely unpleasant.

b) Particularly in the case of miniature loudspeakers that close the auditory passage in a fashion similar to a stopper or plug, their position relative to the auditory passage varies. The original acoustical properties relative to the human ear system also vary as a result. Particularly in the case of users with hearing losses in certain frequency ranges, this leads to acoustical variations that in most cases impair optimal aural reception, aside from the fact that the unequal earpiece pressures from one ear to the other cause variations in the stereophonic balance, which diminish aural reception.

c) Even in the case of miniature loudspeakers that are guided in parallel or nearly parallel fashion relative to the auditory passage and only partially close off the auditory passage, however, every new head position brings about a change in the position of the miniature loudspeakers relative to the external ear/auditory passage, which has a negative impact on wearing comfort, leads to unpleasant-feeling positions, and has a negative effect on aural reception.

SUMMARY OF THE INVENTION

The invention seeks to afford help here. It is a goal of the invention, as it is characterized in the claims, to undertake those measures in the case of a headset of the type stated at the outset that will remedy the above-cited disadvantages in that every variation in head position during the wearing of the headset is correctively captured by a mechanism.

According to the invention it is proposed to develop the miniature loudspeakers, or in the case of conventional headsets the parts of the set enclosing the external ears, in such fashion that the relevant parts in the region of the auditory passage are fashioned to be easily rotatable and they can be adapted to the head and body attitude of the user in each instance, or they can be adapted according to the way the user wears the headset band, without the slightest resulting impairment of the original position in the auditory passage or with respect to the enclosure of the external ears.

The essential advantage of the invention is that this development can be implemented on any kind of miniature loudspeakers and that a maximum of audio transmission quality is attained in this way.

What is more, the development according to the invention makes it possible to maximize wearing comfort, which can only enhance the acceptance of such systems, namely chin-band receivers, headsets, etc., whether cable-connected or cable-less, the cable-less variant being designable for infrared, radio frequency, etc.

Advantageous and expedient developments of the solution of the invention are characterized in the further claims.

In what follows, exemplary embodiments of the invention are explained in greater detail with reference to the drawings. All features not essential to the immediate understanding of the invention have been omitted. Like features in the several figures are identified by the same reference characters.

SUMMARY OF DRAWINGS

In the drawings:

FIG. 3*a* to FIG. 3*c* are various views of the miniature loudspeaker of FIG. 3;

FIG. 4*a* to FIG. 4*c* are various views of the miniature loudspeaker of FIG. 4;

FIG. 5 shows a miniature loudspeaker according to FIG. 3 with a rotatable coupling;

FIG. 6 shows a rotatable coupling of the miniature loudspeaker of FIG. 4 in lateral view;

FIG. 7 is the basic view of the ear side of the miniature loudspeaker of FIG. 4; and FIG. 8 shows the rotatable coupling of the miniature loudspeaker of FIG. 4 in overhead view.

EMBODIMENTS OF THE INVENTION

Commercial Applicability

Figures 1, 2, 3, 4:
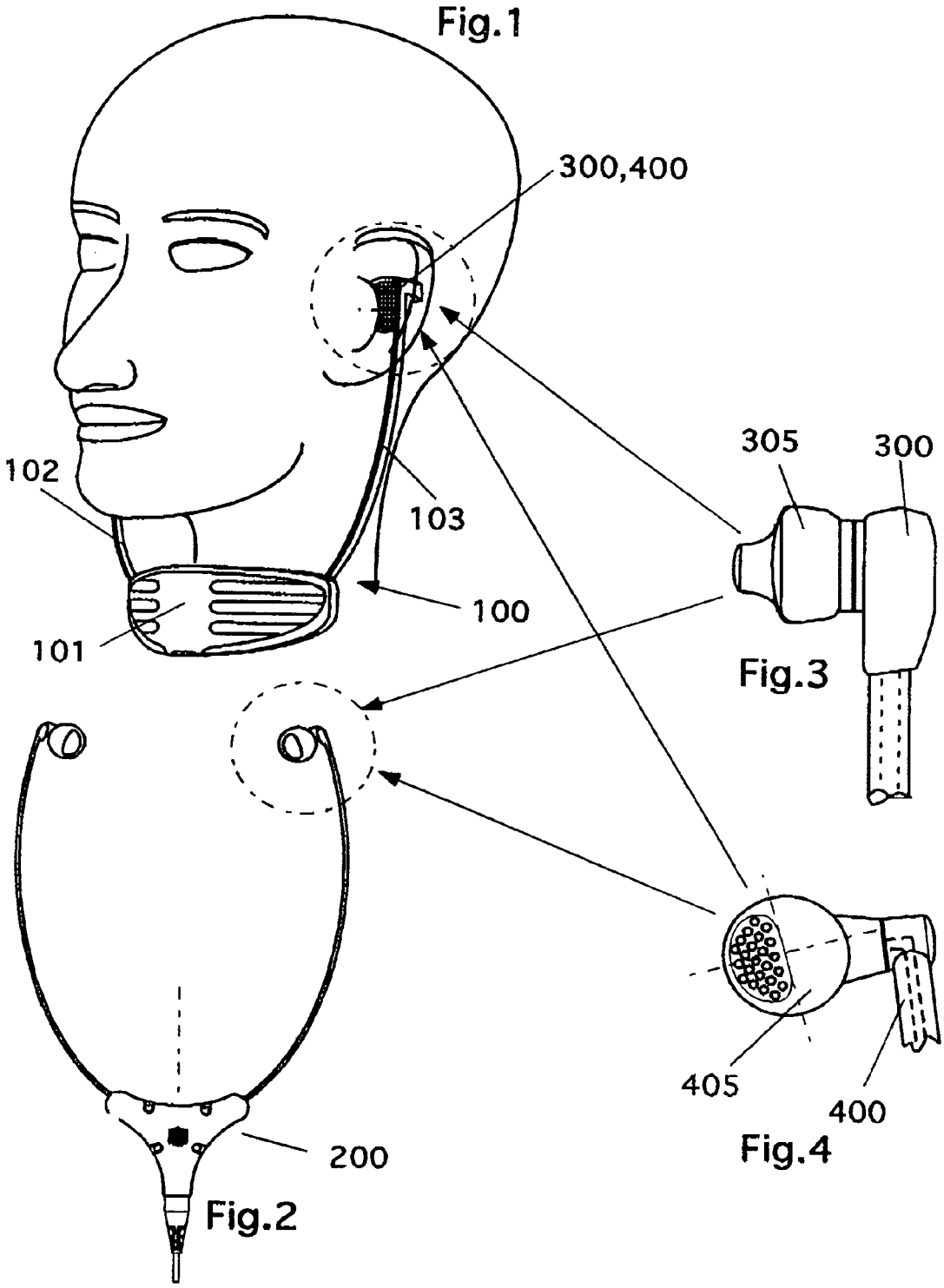
FIG. 1 shows an aural receiver as bearing a chin band.
FIG. 2 shows an aural receiver as bearing a stethoscope headpiece.
FIG. 3 shows a miniature loudspeaker that closes off the auditory passage.
FIG. 4 shows a miniature loudspeaker parallel or nearly parallel to the auditory passage.

Chin-band receiver 100 in FIG. 1 is shown as worn by a user. Such a chin-band receiver 100 is described in detail in publication WO 00/08894, this publication constituting an integral part of the present specification. In summary, this chin-band receiver 100 is an apparatus serving to receive wireless signals such as infrared or radio signals and is designed to transform them into an audio transmission in the audible range. This chin-band receiver 100 here comprises a base housing 101 and two supporting bands 102, 103, with miniature loudspeakers 300, 400 arranged at the end of each. Both supporting bands 102, 103 are supported in base housing 101 and are springingly spreadable in at least one plane. These supporting bands 102, 103 are in effective connection to at least one switch situated in the lever action region of this plane in such fashion that this switch turns on the receiver circuitry at a certain wearing-dependent spreading position of supporting bands 102, 103, so that there is an advantageous automatic turning on and turning off of the receiver in dependence on the wearing of the chin-band receiver. What is more, there is here an audio management that engages automatically through circuitry in dependence on the audio transmission quality that results in the case of interfering reception, in such fashion that either the audio quality is improved or, if the fidelity is below a certain threshold, the transmission is automatically turned off and this transmission is automatically turned on again if the minimal fidelity requirements are restored. The audio management through circuitry further has the property that a changeover from mono to stereo reception or vice versa can be effected at any time. The features described here can of course also be extended to conventional headsets with built-in receivers. All the above-cited functions with respect to audio management should be understood cumulatively and alternatively to one another.

FIG. 2 shows an aural receiver 200 fashioned as a stethoscope headpiece, the audio transmission here also being capable of implementation with a cable. As far as the technology is concerned here, reference is substantially made to the discussion under FIG. 1.

FIG. 3 shows the embodiment of a miniature loudspeaker 300 that is fashioned such that it closes the auditory passage in a fashion similar to a stopper or plug. For the description of this miniature loudspeaker 300 in greater detail, reference is made to FIG. 3*a* to FIG. 3*c* and FIG. 5.

FIG. 4 shows the embodiment of a lenticular loudspeaker body (405) that is guided parallel or nearly parallel to the auditory passage and accordingly closes off the auditory passage only partially and thus leaves it open. For the description of this lenticular miniature loudspeaker 400 in greater detail, reference is made to FIG. 4*a* to FIG. 4*c* and FIG. 6 to FIG. 8.

FIG. 3*a* to FIG. 3*c* show miniature loudspeaker 300 in various views. Such a miniature loudspeaker 300 essentially comprises a base unit 301 provided with acoustical sound holes 307 on the ear side and with further acoustical openings 302 on the back. Attached to base unit 301 is supporting band 303, which here is visible only in part. On the ear side, miniature loudspeaker 300 has a plug-shaped loudspeaker body 305, which closes off the auditory passage. Arranged between base unit 301 and ear-side loudspeaker body 305 is a coupler 308 with attached bushing 309, the connection of the last-named parts 308 and 309 in relation to base unit 301 and loudspeaker body 305 being conceived such that between last-named 305 and base unit 301 there is a capability of free rotatability 306 of a certain angle. Through this development, any variation in the user's head position can be captured in such fashion that loudspeaker bodies 305 of the respective miniature loudspeaker 300, which loudspeaker bodies are firmly seated in terms of position in the auditory passage, as a result of their rotatability with respect to base unit 301, are not subjected to any rotatory pressure, so that wearing comfort is maximized while a maximum of audio transmission quality is attained, since in the case of the latter action there are no acoustical variations in audio transmission associated with position.

FIG. 5 shows, in a section plane, the structure of such a miniature loudspeaker according to FIG. 3*a* to FIG. 3*c*. As has already been noted, coupler 308 connects base unit 301 and loudspeaker body 305, said loudspeaker body in turn being supplemented with a bushing 309, which on the one hand supports loudspeaker 310 and on the other hand as a stop and rotary detent 314 for springing click fingers 313 belonging to coupler 308. The free rotatability of loudspeaker body 305 relative to base unit 301 results from the fact that coupler 308 is firmly connected to base unit 301 and springing click fingers 313 arranged on the opposite side are pushed into bushing 309 and then detained there in barb fashion, these detents determining the specified rotation angle, which always leaves sufficient play so that even extraordinary variations in the user's head attitude can always be captured. The rotatability between base unit 301 and loudspeaker body 305, here proposed through the click technique described, indicates a simple construction that can be employed without restriction, and in any case it makes possible the capture of all body and head attitudes. Both bushing 309 and coupler 308 have a hole 312 through which electrical connecting line 311 can be passed through to loudspeaker 310.

FIG. 6 to FIG. 8 show the design of miniature loudspeaker 400 of FIG. 4*a* to FIG. 4*c*, acoustical openings 402 and acoustical sound holes 407 here being arranged in the large areas of lenticular loudspeaker body 405. The essential difference between this miniature loudspeaker 400 and the preceding one 300 is that here the employment is parallel or nearly parallel to the auditory passage with the auditory passage partly open. The structure of this miniature loudspeaker 400, as far as rotatability 406 is concerned, is largely the same as in the previous miniature loudspeaker (300); that is, here again a coupler 411 with a click finger (analogous to 313) is used to attain the rotatability that serves the end purpose described. The external geometry of this miniature loudspeaker 400 is, of course, different, and it can be inferred without danger of misunderstanding from FIG. 6 to FIG. 8. A snap mechanism 412/413 permits covering part 409 to be clicked into place, and in this way a compact and rounded geometry, very important for unobjectionable wearing of the loudspeaker body in the ear, is obtained. The remaining parts of this miniature loudspeaker 400 have the same functionality as in the preceding miniature loudspeaker (300). Here again, great stress must be laid on the rotatability of the lenticular loudspeaker body (405) in the ear upon any variation in head position, for in this case the coupling in the canal of the ear is not effected by completely closing it off, so that the smallest transmitted displacements result in a disproportionate diminution in audio quality, aside from the fact that such torsions cause unpleasant pressure points.

In the case of headsets where the earpiece surrounds the whole external ear, a rotatability, not shown in more detail in the drawings, can likewise be provided in accordance with the same criteria as already described, so that the supporting band or supporting bands can then be worn on the head in arbitrary fashion.

Figure 9:
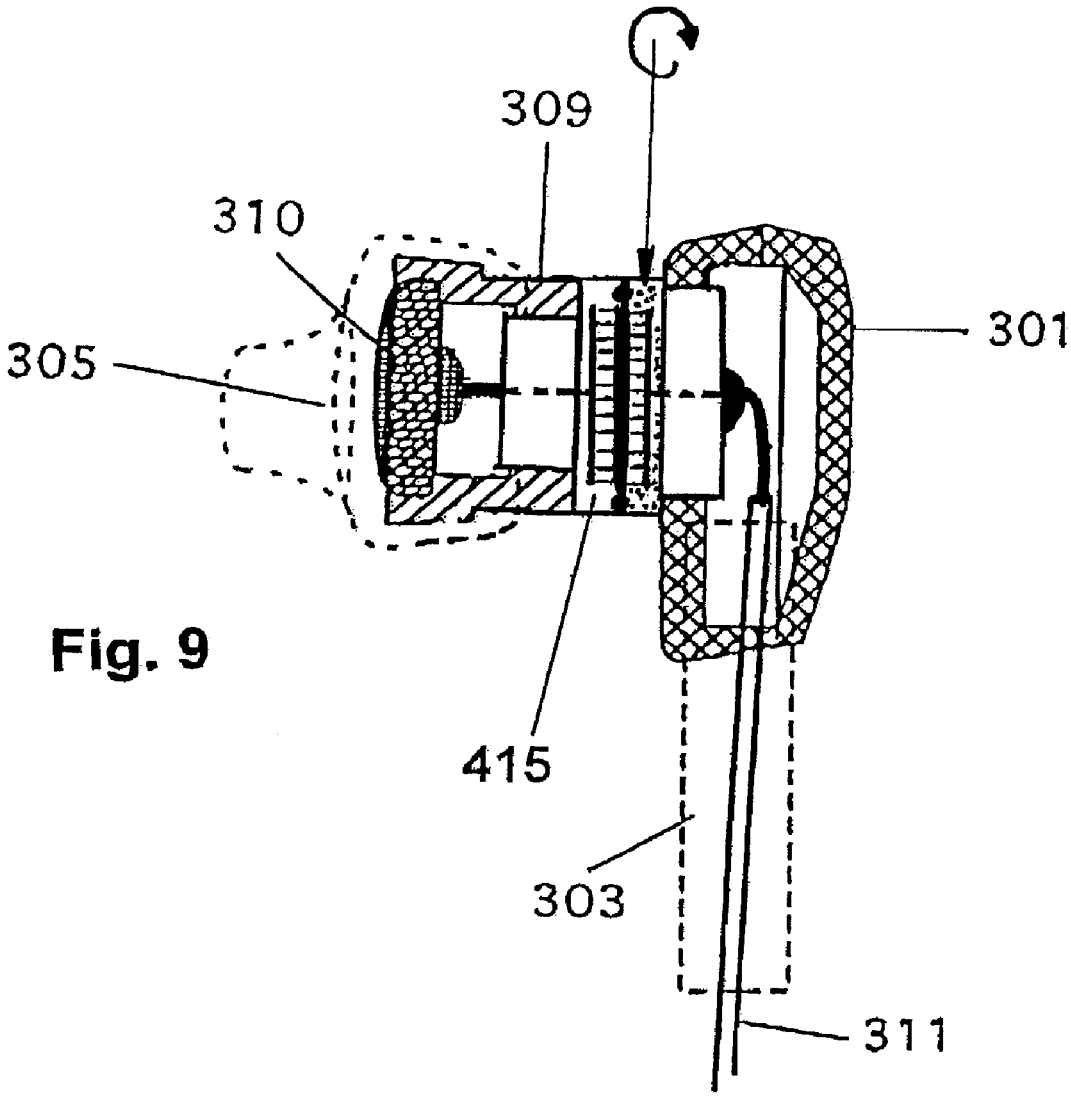
FIG. 9 shows a miniature loudspeaker like that FIG. 5 but with slip-ring contacts between the movable loudspeaker body and the base unit.

Instead of electrical connecting lines 311, 414 described, there can be a connection using slip-ring contacts in the region of the rotatable parts for audio transmission, which slip-ring contacts then secure the electrical connection between movable loudspeaker bodies 305, 405 and respective base units 301, 401. An example is shown in FIG. 9 wherein slip-ring contacts, shown schematically at 415, are located between morable loudspeaker body 305 and base unit 301 like that in FIG. 5 for providing a continuous electrical connection between rotating and stationary conductors.

By incorporating a torsion spring, not shown in greater detail in the drawings, at the suitable location, provision is made that the position of loudspeaker bodies 305, 405 relative to base units 301, 401 resumes the original rest position when the headset is no longer in use.

LIST OF REFERENCE CHARACTERS

100 Chin-band receiver
101 Base housing
102 Supporting band, general
103 Supporting band, general
200 Stethoscope headpiece
300 Miniature loudspeaker
301 Base unit
302 Acoustical openings
303 End part of supporting band
304 Cable duct
305 Loudspeaker body in plug form
306 Rotation angle
307 Acoustical sound holes
308 Coupler
309 Bushing
310 Loudspeaker
311 Electrical connecting line
312 Hole
313 Click finger
314 Stop/rotational detent
400 Miniature loudspeaker
401 Base unit
402 Acoustical openings
403 End part of supporting band
404 Cable duct
405 Lenticular loudspeaker body
406 Rotation angle
407 Acoustical sound holes
408 Connector
409 Covering part
410 Loudspeaker
411 Coupler
412/413 Snap mechanism
414 Electrical connecting line
415 Slip-ring contacts

I claim:

1. A chin-band receiver for receiving infrared or radio signals and transforming them into an audio transmission in the audible range, comprising:

a base housing;

two supporting bands connected to and extending from the base housing to respective ends;

two miniature loudspeakers arranged at respective ones of the supporting band ends;

wherein the miniature loudspeakers each have a loudspeaker body on an ear side of the loudspeaker, which loudspeaker body assumes a place in an auditory passage during use of the chin-band receiver with the receiver hanging vertically downwardly by its own weight; and wherein each loudspeaker body on an ear side is supported with free rotatability with respect to the associated supporting band so that variation in head position of a person using the chin-band receiver does not change the position of the loudspeakers in the auditory passages of the user.

2. The chin-band receiver according to claim 1, wherein each loudspeaker body is supported rotatably with respect to its associated supporting band by way of a joining part.

3. The chin-band receiver according to claim 1, wherein the two supporting bands are formed by respective portions of one continuous band connected to and extending from the base housing.

4. The chin-band receiver according to claim 1, wherein the two supporting bands are two individually guided bands connected to and extending from the base housing.

5. The chin-band receiver according to claim 1, wherein the loudspeaker body on the ear side is in the shape of a plug.

6. The chin-band receiver according to claim 1, wherein the loudspeaker body on the ear side is fashioned in lenticular shape.

7. The chin-band receiver according to claim 1, wherein the supporting bands are supported in the base housing and are spreadable in at least one plane; and the supporting bands are effectively connected to at least one switch situated in a lever action region of said plane; and wherein said switch turns on a receiver circuitry of the chin-band receiver at a certain wearing-dependent spreading position of the supporting bands; wherein the chin-band receiver has an audio management in the form of circuitry, which audio management secures and/or ensures the maintenance of a minimally specified fidelity and/or a changeover from mono to stereo reception; and wherein the transmission automatically turns off if the fidelity goes below a certain fidelity and the transmission automatically turns back on if the fidelity is restored.

8. The chin-band receiver according to claim 1, wherein an electrical connection between a signal receiver belonging to the base housing of the chin-band receiver and the loudspeaker bodies is effected via a connecting line, which is guided internally through the supporting bands and the miniature loudspeakers to the rotatably supported loudspeaker bodies of the loudspeakers.

9. A headset for receiving infrared or radio signals and transforming them into an audio transmission in the audible range, comprising:

a base housing;

two supporting bands connected to and extending from the base housing to respective ends;

two miniature loudspeakers arranged at respective ones of the supporting band ends;

wherein the miniature loudspeakers each have a loudspeaker body on an ear side of the loudspeaker, which loudspeaker body assumes a place in an auditory passage or surrounds the whole of an external ear during use of the headset;

wherein each loudspeaker body on an ear side is supported rotatably with respect to its associated supporting band; and wherein an electrical connection in the region of the rotatable loudspeaker bodies is effected with slip-ring contacts.

10. A chin-band receiver according to claim 1, further comprising a torsion spring arranged at a position, when the chin-band receiver is taken off, to bring the loudspeaker bodies and supporting bands to an original rest position.

11. The chin-band receiver according to claim 1, wherein the miniature loudspeakers each further include a base unit by which the loudspeaker is arranged at the associated one of the band ends, and a coupler with attached bushing arranged between the base unit and the loudspeaker body by which the loudspeaker body is supported with free rotatability with respect to the base unit and the associated supporting band.

* * * * *